US008178800B2

(12) United States Patent
Zuluaga et al.

(10) Patent No.: US 8,178,800 B2
(45) Date of Patent: May 15, 2012

(54) MOMENTARY CONTACT ROTARY SWITCH DEVICE

(75) Inventors: Andrés Felipe Zuluaga, Houston, TX (US); Michael Jonathan Smith, Houston, TX (US); Mark Foohey, Austin, TX (US); Darrell Cavness, Georgetown, TX (US)

(73) Assignee: Remicalm, LLC, Houston, TX (US)

( * ) Notice: Subject to any disclaimer, the term of this patent is extended or adjusted under 35 U.S.C. 154(b) by 447 days.

(21) Appl. No.: 12/589,286

(22) Filed: Oct. 21, 2009

(65) Prior Publication Data

US 2010/0155201 A1 Jun. 24, 2010

Related U.S. Application Data

(60) Provisional application No. 61/206,743, filed on Feb. 4, 2009.

(51) Int. Cl.
*H01H 1/06* (2006.01)

(52) U.S. Cl. ..... 200/276; 200/60; 200/504; 200/564

(58) Field of Classification Search ..... 200/276, 200/50.02, 60, 61.4, 504, 564, 565, 570, 200/332.2, 336, 275
See application file for complete search history.

(56) References Cited

U.S. PATENT DOCUMENTS

| | | | | |
|---|---|---|---|---|
| 646,744 | A * | 4/1900 | Liebscher | 200/276 |
| 2,505,939 | A * | 5/1950 | Blancha | 200/504 |
| 2,955,180 | A * | 10/1960 | Denton | 200/61.08 |
| 4,267,804 | A * | 5/1981 | Rypka | 200/565 |
| 6,781,070 | B1 | 8/2004 | Holt | 200/11 |
| 6,927,348 | B1 | 8/2005 | Schmidt et al. | 200/5 |
| 7,441,920 | B2 | 10/2008 | Kang et al. | 362/205 |
| 7,485,985 | B2 | 2/2009 | Hagberg et al. | 307/10.8 |
| 7,534,975 | B1 | 5/2009 | Sharrah et al. | 200/600 |
| 7,540,625 | B2 | 6/2009 | Matthews et al. | 362/205 |
| 7,543,953 | B2 | 6/2009 | Chapman | 362/205 |
| 7,550,686 | B2 | 6/2009 | Girke et al. | 200/11 |
| 7,550,687 | B2 | 6/2009 | Su | 200/11 |

* cited by examiner

*Primary Examiner* — Felix O Figueroa

(74) *Attorney, Agent, or Firm* — Elizabeth R. Hall

(57) ABSTRACT

A rotary switch for activating selected functions in a hand held device. One embodiment of the invention provides a rotary switch having a rotatable switch selector. Whenever the switch selector is rotated, it reduces the diameter of a torsion spring causing the torsion spring to contact a switch contact and signal a microprocessor to selectably power a particular circuit or a step in a routine.

20 Claims, 7 Drawing Sheets

MOMENTARY CONTACT ROTARY SWITCH DEVICE

CROSS-REFERENCE TO RELATED APPLICATION

The present application, pursuant to 35 U.S.C. 111(b), claims the benefit of the earlier filing date of provisional application Ser. No. 61/203,093 filed Dec. 18, 2008 and entitled "Rotary Switch Device" and of provisional application Ser. No. 61/206,743 filed Feb. 4, 2009 and entitled "Rotary Switch Device."

BACKGROUND OF THE INVENTION

1. Field of the Invention

The invention relates to a selectably operable rotary contact switch. More particularly, the invention relates to a momentary rotary switch having a torsion spring that is reduced in diameter whenever the switch selector is rotated, thereby signaling a microprocessor to power a particular circuit or a step in a routine.

2. Background Art

Modern handheld medical devices typically perform more than one electronically controlled function. Most of these devices control the activation of a particular function by a simple on/off switch. The use of multiple switches to control multiple functions in a handheld multi-functional medical device is problematic. Handheld devices must be simple and comfortable to use. Having multiple switches located on a small handheld device often leads to difficulty in the operation of the proper switch at the right time for the operator and may lead to confusion for the operator of the device.

Thus, there is a need for an easy to operate multi-functional switch that can control multiple functions in a small handheld device. For example, the use of a small medical device for a close-up visual examination must be simple to use with one hand.

SUMMARY OF THE INVENTION

One embodiment of the invention provides a rotary switch having a rotatable switch selector. Whenever the switch selector is rotated, it reduces the diameter of a torsion spring causing the torsion spring to contact a switch contact and signal a microprocessor to selectably power a particular circuit or a step in a routine.

A second embodiment of the invention is a rotary switch for activating a multifunctional powered device, the switch comprising: a torsion spring having a first end anchored in a device housing; a rotatable switch selector ring, wherein a second end of the torsion spring is engaged in a detent in the switch selector ring; a plurality of coaxial conductors separated by electrically nonconductive insulators, the coaxial conductors including a first contact, a second contact, and a switch contact, wherein when the switch selector ring is rotated in a first direction the internal diameter of the torsion spring is reduced and contacts the switch contact; a microprocessor in communication with the switch contact; and an electrical system in communication with the microprocessor and the multifunctional powered device.

A third embodiment of the invention is a rotary switch for activating a multifunctional powered device, the switch comprising: a battery housing including an interior having a negative potential; a conductive torsion spring having a first end anchored in contact with the interior of the battery housing; a rotatable switch selector ring, wherein a second end of the torsion spring is engaged in a detent in the switch selector ring; a plurality of coaxial conductors separated by electrically nonconductive insulators, the coaxial conductors including a first contact in communication with a positive terminal of a battery, a second contact in communication with the interior of the battery housing, and a switch contact, wherein when the switch selector ring is rotated in a first direction the internal diameter of the torsion spring is reduced and contacts the switch contact; a microprocessor in communication with the switch contact; and an electrical system in communication with the microprocessor and the multifunctional powered device.

Yet another embodiment of the invention is a rotary switch for activating a multifunctional powered device, the switch comprising: a battery housing having a conductive interior; a conductive torsion spring having a first end anchored in contact with the interior of the battery housing; a rotatable switch selector ring, wherein a second end of the torsion spring is engaged in a detent in the switch selector ring, whereby when the switch selector ring is rotated in a first direction the second end of the torsion spring is moved toward the first end of the torsion ring placing the torsion ring in a contracted state and when the switch selector ring is released after the torsion spring is contracted the second end of the torsion ring moves away from the first end of the torsion ring and the torsion ring resumes an at rest state; a plurality of coaxial conductors separated by electrically nonconductive insulators, the coaxial conductors including a first contact in communication with a positive terminal of a battery, a second contact in communication with the interior of the battery housing, and a switch contact, wherein when the torsion ring is in the contracted state an internal diameter of the torsion spring contacts the switch contact; a microprocessor in communication with the switch contact, wherein the multifunctional powered device has a set of functions and the microprocessor selectably powers one function of the powered device based on a number of times the torsion ring has contacted the switch contact; and an electrical system in communication with the microprocessor and the multifunctional powered device.

The foregoing has outlined rather broadly several embodiments of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed might be readily utilized as a basis for modifying or redesigning the structures for carrying out the same purposes as the invention. It should be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Figure 1:
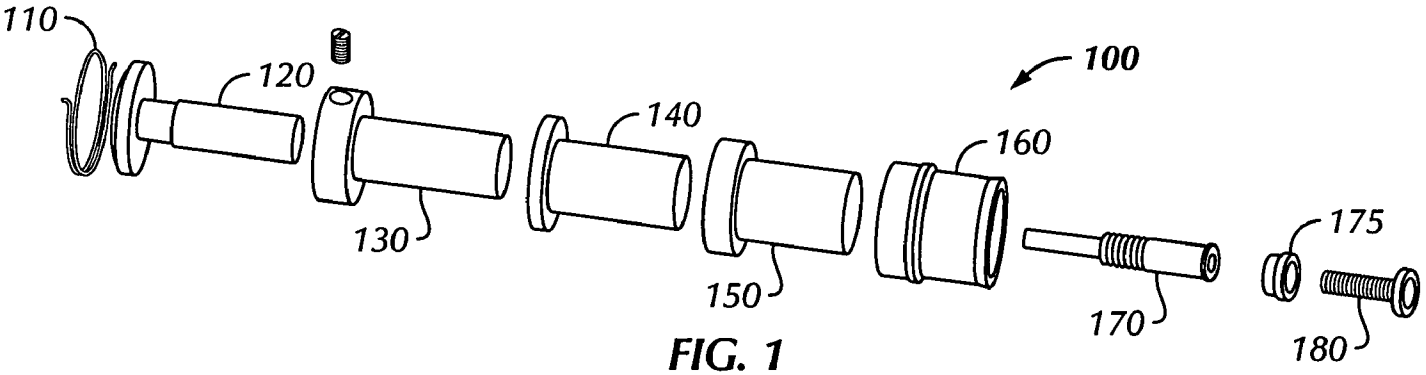
FIG. 1 shows an exploded view of one embodiment of the switch assembly.

The present invention relates to an operable rotary momentary contact switch. Whenever the rotary switch is rotated it reduces the diameter of a torsion spring and thereby signals a microprocessor to selectably power a particular circuit or a step in a routine.

The rotary switch is typically mounted to communicate with a power source on one end and to a microprocessor or electrical assembly on the other end. The rotary switch includes a torsion spring 110, a rotatable switch selector ring 210, a first contact 170, a first contact insulator 120, a second contact 130, a second contact insulator 140, a switch contact 150, and a switch contact insulator 160. These basic components may be implemented in a variety of embodiments and can be packaged in a number of configurations without departing from the scope of the invention as set forth in the claims.

The Spring Assembly

One embodiment of the switch 100, as illustrated in FIGS. 1-4, has an electrically conductive first contact 170 having a positive potential, a second contact 130 having a negative potential, and a switch contact 150 coaxially aligned and separated by electrically nonconductive insulators.

Figure 5A:
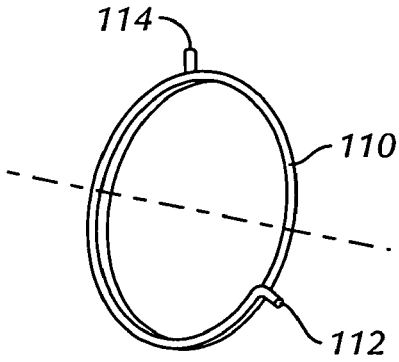
FIG. 5A is an oblique view of the torsion spring.
Figure 5B:
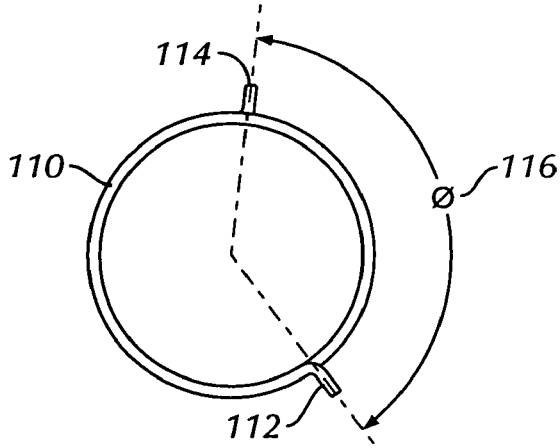
FIG. 5B is a top view of the torsion spring.

An active part of the switch mechanism is a torsional contactor spring 110, shown in FIGS. 5A and 5B. The torsion spring 110 is typically circular and made with a close-wound electrically conductive wire. The torsion spring 110 is positioned such that when the diameter of the torsion spring is reduced a set amount at least a portion of the internal diameter of the torsion ring contacts the switch contact 150.

The torsion spring 110 has a high enough yield point and fatigue limit such that it can be repeatedly cycled between a first at-rest position and a second contracted position. It is the second contracted position that establishes an electrical contact between the torsion spring 110 and a conductive element mounted within the bore of the torsion spring 110.

Figure 6:
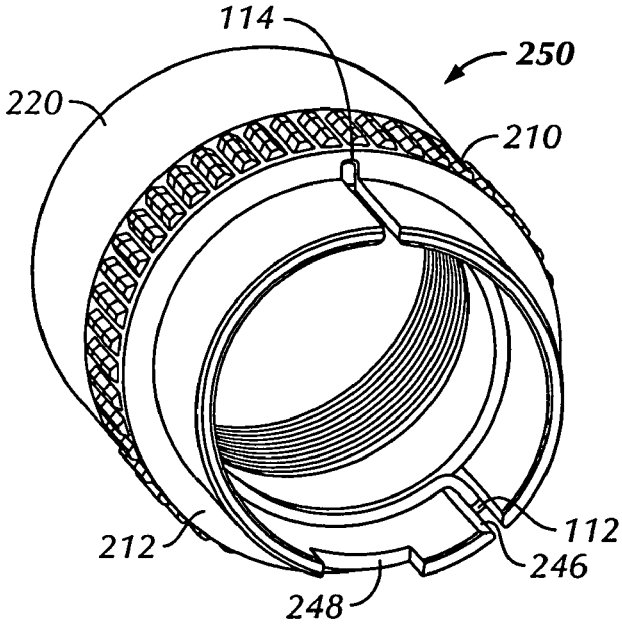
FIG. 6 is an oblique view of a switch subassembly illustrating the interaction of the connector nut, the switch selector, and the torsion spring.

The torsion spring 110 has a radially outwardly projecting section on each end separated by an angle Φ 116. As shown in FIG. 6, one outwardly projecting end referred to as the static end 112 is engaged with a second slot 246 on a connector nut 220 and a detent 262 in the electrically conductive inside of the battery housing 260. The second outwardly projecting end, or the rotatable end 114, is engaged with a similar detent 214 in a first end 212 of a rotatable switch selector ring 210. Thus, when the switch selector ring 210 is rotated, the rotatable end 114 of the torsion spring 110 is moved towards the static end 112 of the torsion spring 110 and the diameter of the torsion ring 110 is reduced so that the torsion ring 110 contacts the switch contact 150.

Figure 7:
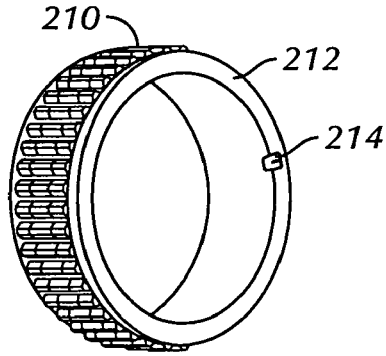
FIG. 7 is an oblique view of the switch selector ring.

FIG. 7 shows an oblique view of the switch selector ring 210 from a first end. The switch selector ring 210 is an axially short ring with a knurled outer diameter and a smooth bore which is a slip fit to the reduced outer diameter portion of the connector nut 220, shown in FIGS. 8 and 9. The second end of the switch selector ring 210 abuts the leftward facing intermediate exterior shoulder of the connector nut 220 and is rotatable about the connector nut 220.

The connector nut 220 has, from its first end 222, an exterior right circular cylindrical portion 230 which has a mild interference fit with the counterbore at the second end of the battery housing 260 to which it can be mounted with a press fit. At its second end 224, the connector nut 220 has an enlarged exterior cylindrical portion 232. The two exterior surfaces are joined by a transverse shoulder 226 facing the first end 222. The connector nut 220 has a straight through bore 228 with a counterbore at its second end. The counterbore has a female thread 234 combatable with a corresponding male thread 306 on the first end 304 of the connector screw 300 shown in FIG. 10.

Figure 8:
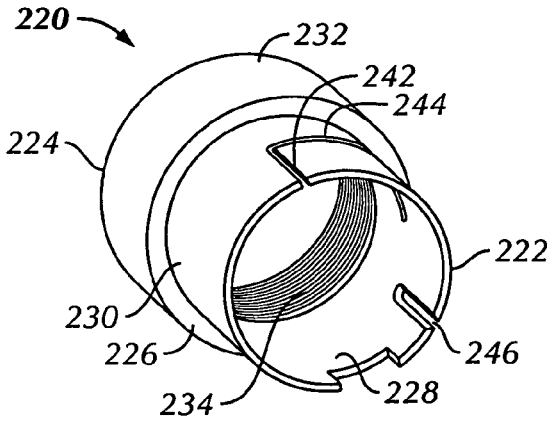
FIG. 8 is an oblique frontal view of the connector nut.
Figure 9:
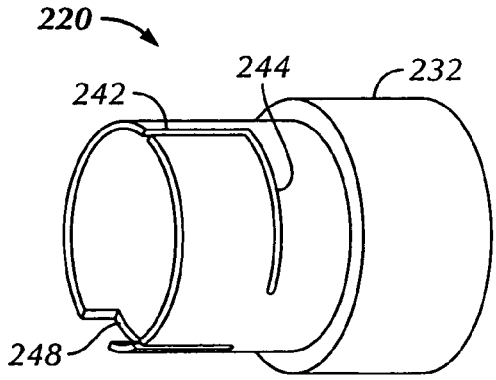
FIG. 9 is an oblique side view of the connector nut.

The connector nut 220 has four slots as shown in FIGS. 8 and 9. The first slot 242 is in a radial plane of the connector nut and extends approximately 40% of the length of the connector nut 220 away from the first end 222 of the connector nut. The distal end of the first slot 242 intersects a transverse circumferential slot 244 which extends approximately 90 degrees clockwise from the first slot 242 when viewed from the first end. The first slot 242 and the circumferential slot 244 are slip fits to the radially outwardly extending rotatable end 114 of the torsion spring 110.

A second slot 246 of the connector nut 220 is also in a radial plane and extends inwardly away from the first end 222. The length of the second slot is typically slightly less than that of the first slot. The second slot 246 serves as a detent for the static end 112 of the torsion spring 110.

A rectangular clearance slot 248 for a leaf spring 270 is located at the first end 222 of the connector nut 220. This clearance slot 248 provides a passage for the leaf spring 270 to contact the second contact 130 of the switch 100. Thus, the leaf spring 270 is attached to the conductive interior of the battery housing on one end and contacts the second contact 130 on the other end.

Figure 10:
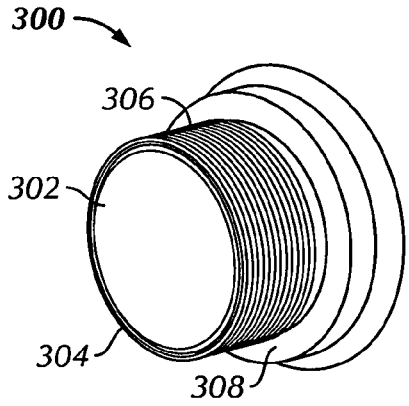
FIG. 10 is an oblique view of the connector screw.
Figure 11:
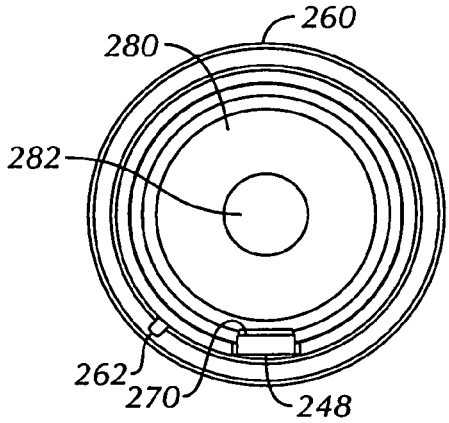
FIG. 11 is an end view of one embodiment of the battery housing.

The connector screw 300 shown in FIG. 10 has a straight bore 302 which has substantially the same diameter as the through bore 228 of the connector nut 220. The exterior of the connector screw has, moving inwardly from its first end 304, a male connecting thread 306, a transverse shoulder 308 facing its first end 304, a short enlarged right circular cylindrical segment, a frustroconical segment which enlarges towards the second end of the part, and a transverse shoulder facing the second end. The male thread 306 of the connector screw 300 is threadedly combatable with the female thread 234 of the connector nut 220.

The spring assembly 250 seen in FIG. 6 includes the connector nut 220 as a hub, the switch selector ring 210, and the torsion spring 110. The switch selector ring 210 is first abutted against the external shoulder 226 of the connector nut 220 and then the torsion spring 110 is installed within the bore 228 of the connector nut 220 by engaging the radially outwardly extending arms of the torsion spring 110 in the first slot 242 and the second slot 246 of the connector nut 220.

The rotatable end 114 of the torsion ring 110 is positioned in the spring assembly 250 by first aligning the detent 214 on the first end 212 of the switch selector ring 210 with the first slot 242 of the connector nut 220. The rotatable end 114 of the torsion spring 110 is then entered into the first slot 242 until it comes to a stop at the intersection of the first slot 242 and the circumferential slot 244. While in this position in the first slot 242, the rotatable end 114 of the torsion spring 110 is engaged with the detent 214 on the first end 212 of the switch selector ring 210. At about the same time as the rotatable end 114 of the torsion spring is engaged with the detent 214, the static end 112 of the torsion spring 110 is entered into the second slot 246 of the connector nut.

The torsion spring 110 as initially positioned is essentially unstressed, or only very lightly loaded. The static end 112 of the torsion spring 110 is held in the detent 262 in the battery housing and the rotatable end 114 is held in the detent 214 in the rotatable switch selector ring 210 by the abutment of the ends of the torsion spring with the mating transverse shoulders of those parts.

Whenever the switch selector ring 210 is rotated in a clockwise direction when seen from its first end relative to the connector nut, the rotatable end 114 of the torsion spring 110 is brought closer to the entrapped static end 112 of the torsion spring to reduce the angle Φ 116 between the two ends. Reducing the angle Φ between the static end 112 and the rotatable end 114 reduces the bore diameter of the spring 110 and puts the spring 110 in a contracted state. Once the switch selector ring 210 is released, the torsion spring 110 will expand to its original at-rest position that separates the static end 112 from the rotatable end 114 by angle Φ. As the torsion spring expands to its original at-rest position, it biases the switch selector ring 210 through the detent 214 to return to its original position.

The at-rest through diameter of the torsion spring 110 is larger than the largest outer diameter of the components of the switch assembly 100. When the switch contact 150 of the switch assembly is positioned within the bore of the torsion spring 110, sufficient rotation of the switch selector ring 210 reduces the internal diameter of the torsion spring 110 enough to make electrical contact between the torsion spring 110 and the switch contact 150. Releasing the switch selector ring 210 permits the spring 110 to rotate back counterclockwise, thereby breaking the electrical contact.

One advantage of using the switch selector ring 210 and the torsion spring 110 as described is that the switch selector ring 210 can be configured to rotate in either a clockwise or a counterclockwise direction and whenever the device is held in any orientation. Furthermore, the simple rotation of the switch selector ring 210 to initiate a selected action of a powered device allows the powered device to be easily activated using one hand.

The Switch Assembly

Referring to FIGS. 1 to 4, the switch assembly 100 is shown in an exploded view, from both ends and also in a longitudinal sectional view. The outer diameter of the switch assembly 100 is less than the bores of the connector screw 300, the connector nut 220, and the at-rest torsion spring 110. The switch assembly has three coaxial conductors which are separated by intermediate electrically nonconductive insulators. Generally, the nonconductive insulators are made of an elastomeric material.

A first contact 170 is located in the center of the switch assembly 100 on the assembly axis. The first contact 170 is typically made of brass. A first end of the first contact 170 has an elongated small diameter cylindrical shank, adjoined by a larger intermediate diameter exterior segment with multiple shallow annular grooves intermediate to the length of the segment. A second end of the first contact 170 has a small outwardly extending transverse shoulder. In addition, one embodiment of the second end of the first contact 170 has a coaxial drilled and tapped hole having a female thread engagable with a screw 180, as seen in FIG. 1.

Moving from a first end of the switch assembly 100 towards a second end, one embodiment of the nonconductive first contact insulator 120 has an upset transverse flange with a shallow central inwardly offset depression, a short reduced diameter cylindrical shank, and a slightly larger cylindrical elongated extension. From its first end, the first contact insulator 120 has a through bore which is a close slip fit to the first end of the first contact 170, followed by a slightly larger intermediate counterbore which has an interference fit with the annularly grooved section of the first contact. At its second end, the first contact insulator 120 has a second, larger counterbore which has a loose fit to the second end enlarged portion of the first contact 170.

The second contact 130, typically made of brass, is a thin walled tube having a thick transverse external flange at its first end. The bore of the second contact is a slip fit to the second exterior end of the first contact insulator 120. The embodiment shown in FIG. 1 has a radial drilled and tapped through hole for a set screw located about midway to the axial length of the external flange of the second contact 130.

The second contact insulator spacer 140 is a nonconductive thin walled tube having a relatively axially short external transverse flange at its first end. The through bore of the second contact insulator spacer 140 has a slip fit with the external portion of the tube of the second contact 130.

The switch contact 150, similar to the second contact 130, is a thin walled tube having a thicker outwardly projecting transverse flange than the second contact insulator spacer 140 at its first end. The inner diameter of the through bore of the switch contact 130 has a slip fit with the exterior of the tube of the second contact insulator spacer 140.

The attachment ring or switch contact insulator 160 has a straight bore at its first end with a slightly larger counterbore at its second end. The length of the bore and counter bore are approximately equal. On its exterior surface, the attachment ring contact insulator 160 has a first cylindrical section, a narrow transverse flange which is only slightly larger than the first cylindrical section, a short reduced diameter section, a longer cylindrical undercut, and another axially short flange which is only slightly larger than the adjacent undercut.

The contact insulator washer 175 is an annular piece having a through bore which is a loose fit to the threads of the screw 180 used to attach the switch assembly to a contact board 410 of an electrical assembly 400. The exterior of the contact insulator washer 175 has a short cylindrical first segment at its first end and a short transverse flange which is a slip fit to the bore of the second contact 130 at its second end.

Figure 4:
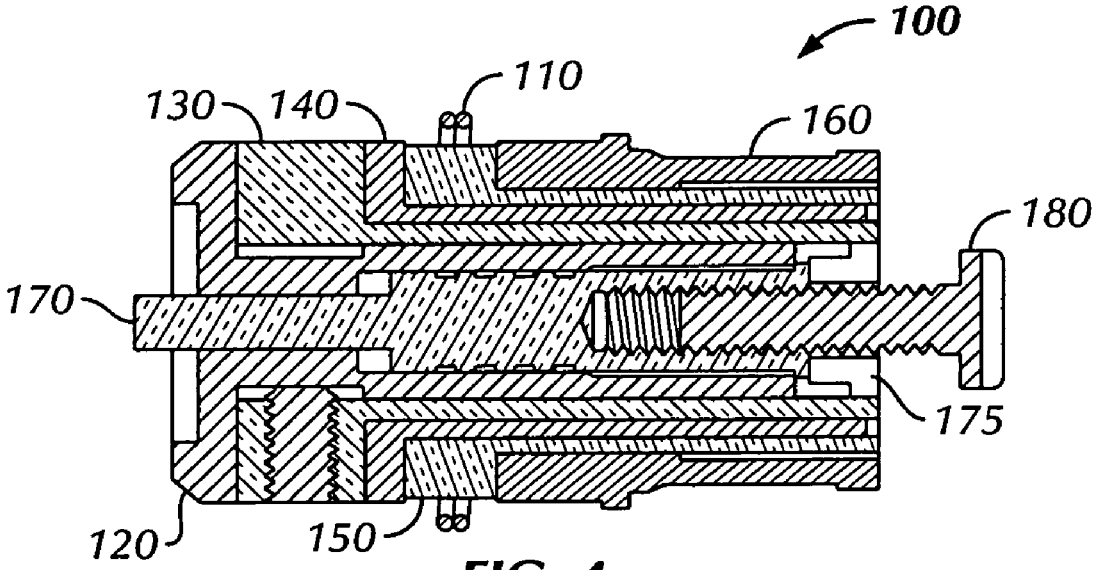
FIG. 4 is a longitudinal cross-sectional view of the switch assembly of FIG. 1.

The assembly of the components of the switch assembly 100 is shown in FIG. 4. The first contact 170 is press fitted into the middle counterbore of the first contact insulator 120 until its flange abuts the second end of the first contact insulator 120. The first end of the first contact 170 protrudes outwardly from the first end of the switch assembly. The first end of the first contact 170 typically makes electrical contact with the positive terminal 282 of a power source, such as a battery. The screw 180 communicates that positive electrical contact with the first contact ring 412 of the contact board 410 of the electrical assembly 400.

Moving radially outwardly at the second end of the switch assembly 100 is the first end of the second contact 130, the second contact insulator 140, the switch contact 150, and the switch contact insulator 160. When fully assembled in the switch 100, the second transverse ends of both the second contact 130 and the switch contact are flush; whereas the second ends of the contact insulator washer 175, the second contact insulator 140, and the switch contact insulator 160 are either flush or slightly recessed in the first direction from the flush faces of the second and switch contacts. When the switch 100 is attached to the contact board 410, the second transverse end of the second contact 130 is in communication with the second contact ring 414 and the switch contact 150 is in communication with the third contact ring 416.

The Handle Assembly

Figure 12:
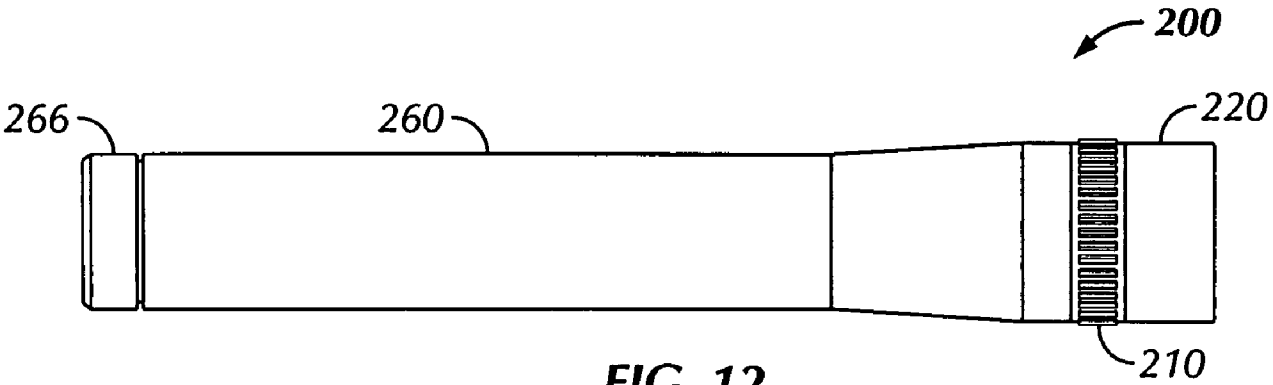
FIG. 12 is a side view of one embodiment of the handle assembly.
Figure 13:
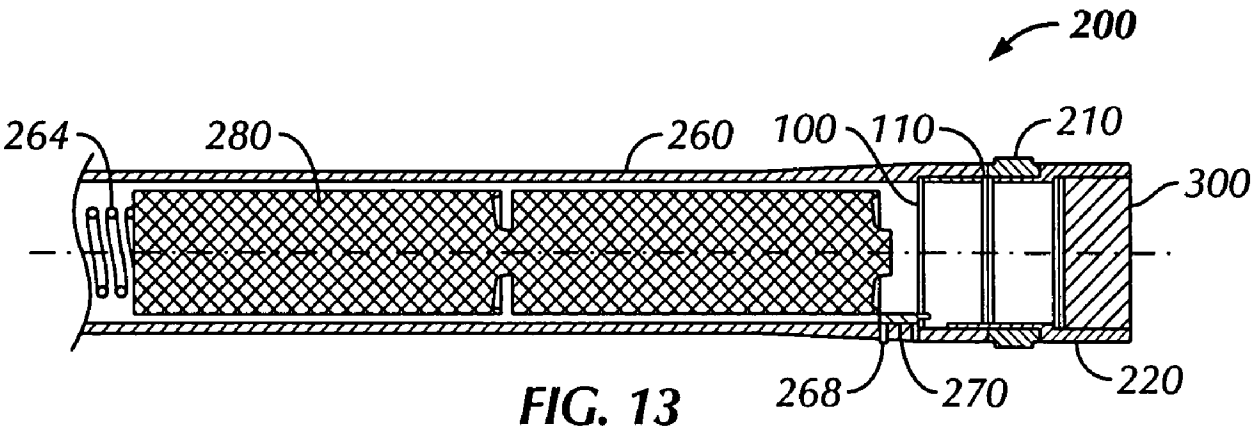
FIG. 13 is a longitudinal sectional view of the handle assembly of FIG. 12.

The handle assembly 200, shown in FIGS. 12 and 13, includes an end cap 266, a battery housing 260, a battery contactor spring 264, one or more batteries 280, a leaf spring 270 riveted by the rivet 268 to the interior of the battery housing 260, the spring assembly 100, the switch selector ring 210, and the connector screw 300.

Figure 2:
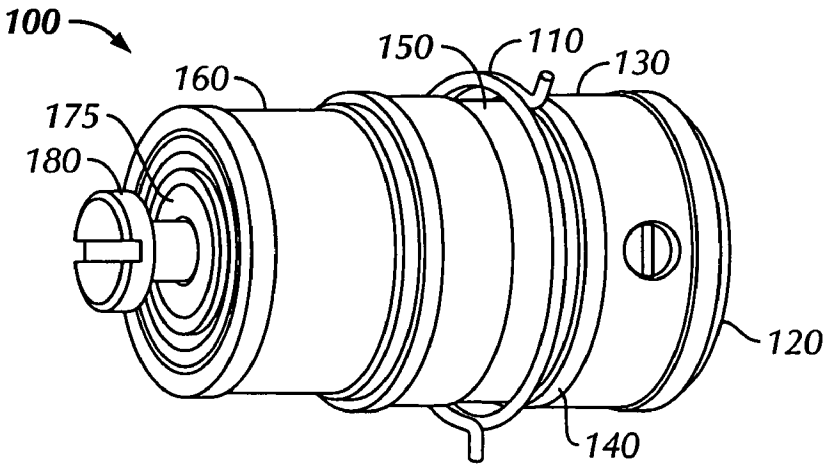
FIG. 2 is an oblique view of the switch assembly of FIG. 1.
Figure 3:
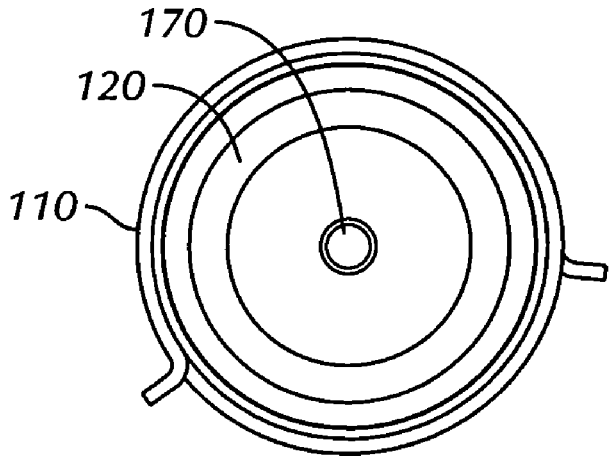
FIG. 3 is an end view of the switch assembly of FIG. 1.

In order to press fit the subassembly of FIG. 2 into the counterbore at a second end of the battery housing 260, both the leaf spring clearance slot 248 on the connector nut 220 must be aligned with the leaf spring 270 and the housing detent 262 for the static arm 112 of the torsion spring 110 on the second end of the battery housing 260 must be aligned with the second slot 246 of the connector nut 220. The press fitting is done so that the switch selector ring 210 is still freely rotatable about the connector nut 220. The press fitting completes the handle assembly 200, shown in FIGS. 12 and 13.

The Electrical Assembly

Figure 14:
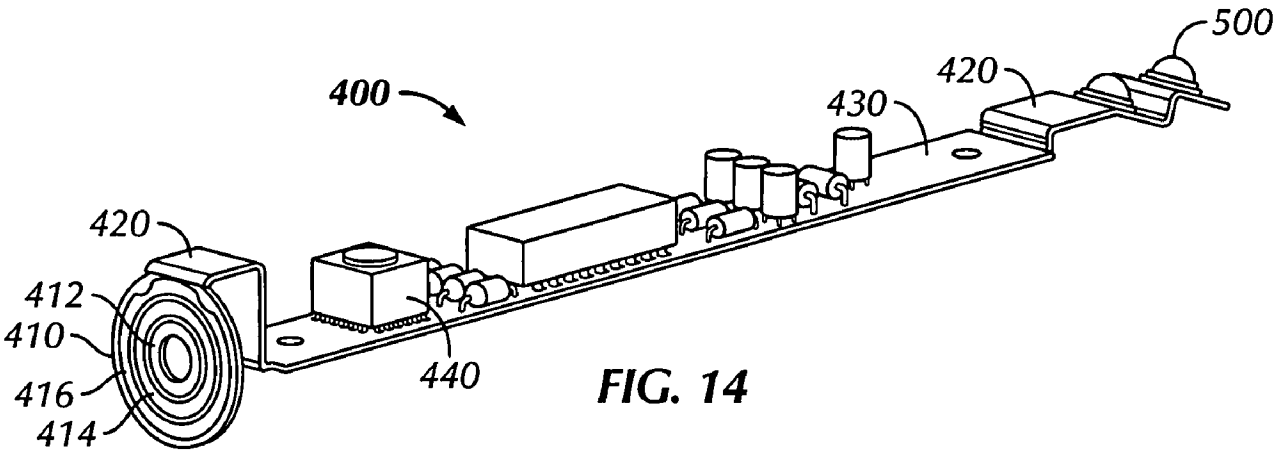
FIG. 14 is a perspective view of one embodiment of a contact pad and circuit board for communicating with the rotary switch.

The electrical assembly 400 is shown in FIG. 14. The electrical assembly includes a contact board 410, a flex cable 420, a microprocessor 440, and a printed circuit board 430. The electrical assembly 400 serves to interconnect the power source, the switch assembly 100, and a powered device 350. Thus, when the switch assembly 100 is activated power passes to the powered device 350 to activate it.

The torsion spring 110 located in the handle assembly 200 is induced to contract inwardly by the selectable rotation of the switch selector ring 210. When the switch selector ring 210 is rotated in a first direction, the diameter of the torsion spring 110 is reduced so that a potion of the internal circumference of the torsion spring contacts the switch contact 150. Thus, the electrical contact made between the conductive interior of the battery housing 260 that is often negatively charged and the torsion spring 110 is translated to the switch contact 150 whenever the torsion spring 110 touches the switch contact 150.

One end of the leaf spring 270 is mounted to the conductive interior of the battery housing 260 while the second end of the leaf spring extends inwardly and makes contact with the second contact 130 of the switch assembly 100. In addition, the first end of the first contact 170 generally abuts the positive terminal of the battery 282 at the second end of the battery housing 260. The set screw 180 is connected to the second end of the first contact and attaches the switch 100 to the contact board 410 and the heat sink 450. Thus, the screw 180 makes electrical contact with the second end of the first contact 170 and with the electrical assembly 400 on its second end.

When the switch 100 is turned on, it is necessary to establish both the normal positive and negative electrical continuity through the switch assembly 100 so that an interconnected electrical assembly 400 is powered at all times during operation. The electrical assembly interconnected microprocessor 440 is mounted on the printed circuit board 430. The operator selectable momentary make/break contact of the rotary switch 100 is used to signal the microprocessor. Every time the switch 100 is turned on a register of the microprocessor keeps count of the number of rotary switch actuations. According to the number of activations, the microprocessor is programmed to select a particular circuit for activating a function of the powered device 350.

One embodiment of the microprocessor register counts from zero to three and resets the count to zero for actuations which are integral multiples of four. Thus, four functions of the powered device 350 are individually activatable. If the reset point for the microprocessor were changed, then the number of function options would correspondingly change.

Figure 16:
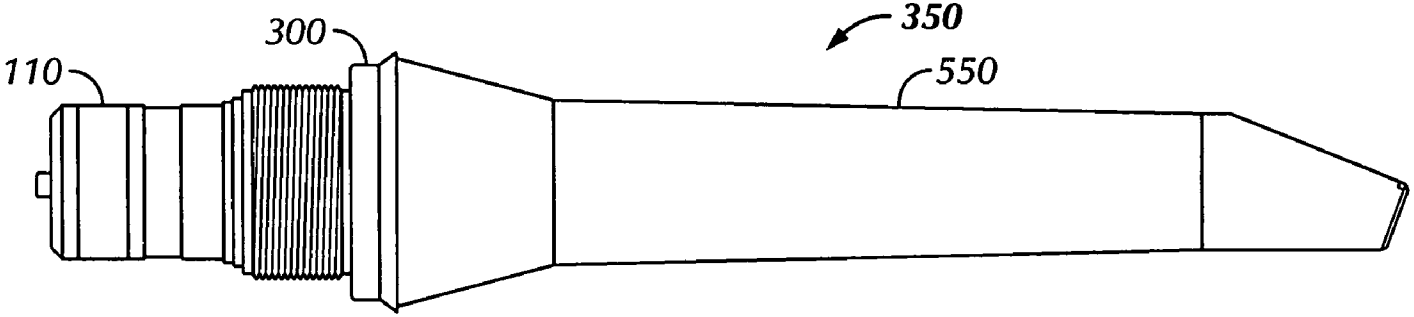
FIG. 16 is a side view of one embodiment of the electrical housing connected to an embodiment of the rotary switch.

One example, of a powered device 350 activated by the switch 100 is a handheld device containing an illumination source illustrated in FIG. 16. The illumination source contains a set of light emitters such that one or more emitter is powered whenever a circuit is activated by a rotary switch actuation.

Figure 15:
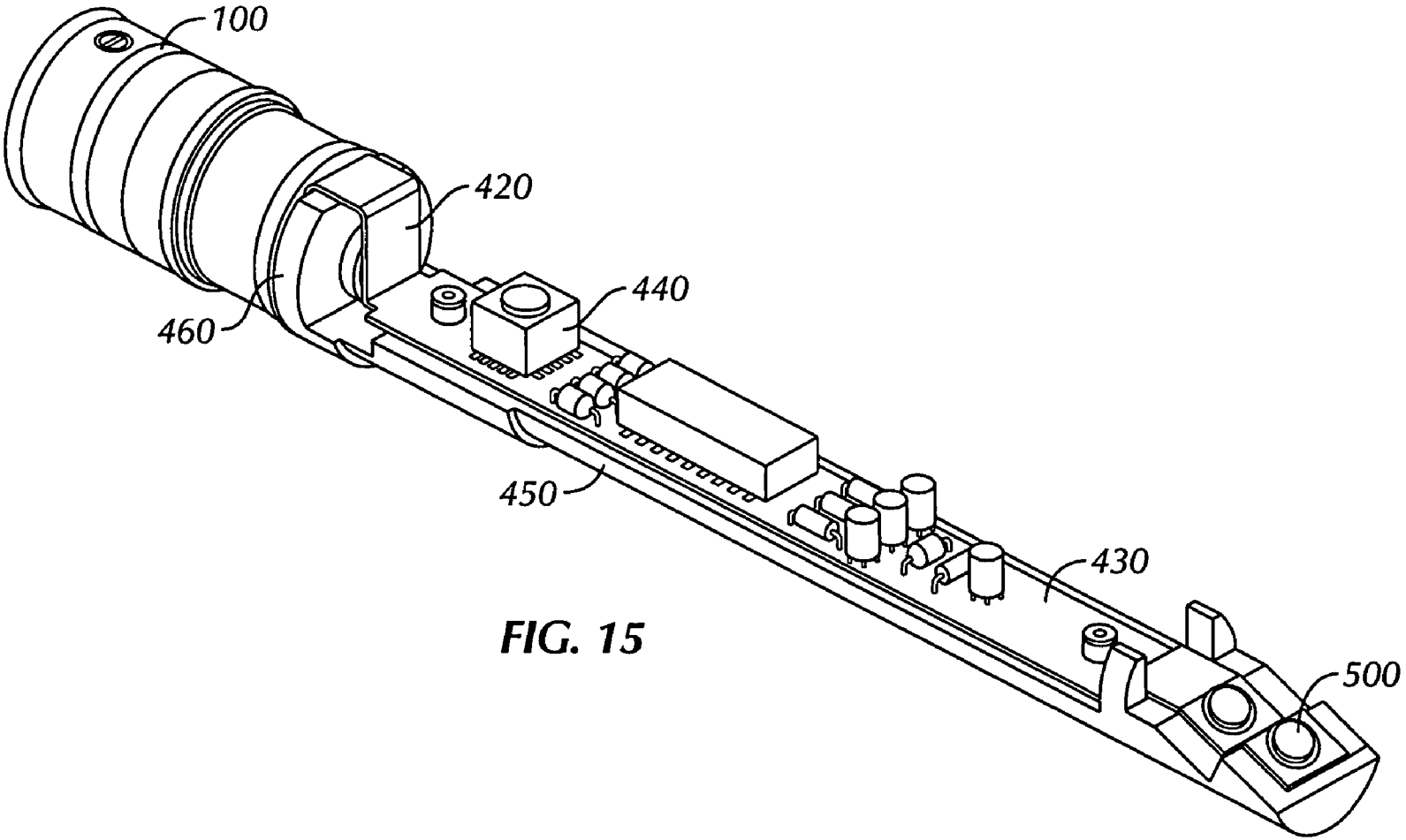
FIG. 15 is a perspective view of one embodiment of the switch assembly connected to the contact pad and circuit board of FIG. 14.

As illustrated in FIG. 15, the illumination source may be one or more LED units 500, where each unit has one or more LEDs attached thereto. For example, one or more of the LEDs within an LED unit 500 are wired on a particular circuit and activated whenever that particular circuit is activated. Thus, each rotation of the selector switch 100 triggers the microprocessor to activate a predetermined circuit designed to activate one or more LEDs to produce a particular wavelength of light, or combination of wavelengths.

FIG. 14 is an oblique view of the electrical assembly 400 which shows the printed circuit board holding the primary electrical and electronic components of the control system of the powered device 350. One embodiment of the contact between the three conductors of the switch assembly 100 and the microprocessor is established by a thin planar cylindrical transverse contact board 410 of the flex cable 420 at the first end of the printed circuit board 430.

The contact board 410 has three concentric conductive rings on its transverse face at its first end. These three concentric conductive rings are electrically isolated from each other by the generally nonconductive body of the flex cable 420. The conductive rings are connected to the printed circuit board 430 by wiring traces (not shown) in the flex cable 420 at the first end of the printed circuit board 430.

The diameters of the three conductive rings are such that the intermediate ring 414 contacts the second end of the second contact 130 of the switch assembly 100 and the third contact ring 416 contacts the second end of the switch contact 150 of the same switch assembly. The central hole of the disk element provides passage for the screw 180 of the switch assembly 100, which is connected to the first contact 170 of the switch assembly. The screw 180 abuts the second side of the transverse first centralizing bulkhead 460 of the heat sink 450, thereby establishing electrical contact between the positive terminal of the batteries and the heat sink 450.

In the embodiment of the powered device 350 described herein, the function of the printed circuit board and its associated electronic and electrical components is to provide electric power in an operator selected manner to the LEDs in the LED units 500 to activate the output of predetermined wavelengths of light from those LED units. The main printed circuit board is typically a planar piece of nonconductive plastic having a thin elongated rectangular body with a microprocessor and other components mounted on its upper side.

Copper traces are provided on the circuit board to interconnect the components of the control circuitry as needed. The copper traces can be on both the lower and upper sides of the circuit board. At its first end, the printed circuit board is attached to the flex cable which is attached to the contact board 410 for contacting the switch assembly 100, thereby bringing power to the circuits on the printed circuit board 430.

At its second end, the printed circuit board is attached to a second flex cable which mounts the first and second LED units 500, as seen in FIG. 15. The second flex cable contains flexible conductive traces which are in electrical communication with the terminals on the first and second LED units 500.

The printed circuit board or PCB 430 is provided with a pair of through holes to facilitate its mounting by screws onto an aluminum heat sink 450. These screws are electrically isolated from the conductive traces on the PCB 430. In the embodiment shown in FIG. 15, all of the electronic components of the main PCB 430 are located on the upper side of the board. Additional electrical connector terminals are also provided on the main PCB 430 to connect to the eight lead wires supplying power to the LED units 500 via the second flex cable. The subassembly of the heat sink 450, the electrical assembly 400, and the switch assembly 100 are shown in an oblique view in FIG. 15.

As seen in FIG. 15, the heat sink 450 is an elongated bar having a substantially planar horizontal upper surface adjacent and parallel to the PCB axis and an opposed circularly arcuate obverse side. The heat sink is made by first turning a stepped elongated cylindrical piece which has at its first end a short enlarged cylindrical section, followed by another reduced diameter cylindrical section having a length equal to approximately 18% of the part and finally a long smaller diameter cylindrical section. The turned piece is then milled away to produce sequentially from its first end a transverse mounting bulkhead 460, a narrow transverse clearance slot, the flat central PCB mounting surface, a short second transverse bulkhead, and two faces inclined to the longitudinal axis of the part.

The inclined faces are mounting faces for the LED units 500 attached to the second flex cable of the printed circuit board 430. The clearance notch adjacent the first bulkhead 460 of the heat sink 450 is needed to provide space for inserting the screw 180 which both attaches the heat sink 450 to the switch assembly 100 and clamps the intermediately positioned transverse disk contact board 410 of the first flex cable to the second end of the switch assembly 100.

The upper surface of the heat sink 450 is flat except for two drilled and tapped mounting bosses for the main PCB 430. A central through hole penetrates the first bulkhead of the heat sink on the part axis, and a flat parallel to the mounting surface of the heat sink is machined on the upper side of the first bulkhead in order to permit passage of the first flex cable. The second bulkhead has an axially central notch for accommodating the second flex cable.

The electrical assembly 400 and the heat sink 450 are covered by an electrical housing 550 shown in FIG. 16. The electrical housing 550 is attached to the connector screw 300 which allows the electrical assembly 400 and the switch assembly 100 to attach to the handle assembly 200.

One advantage of using switch assembly 100 with the switch selector ring 210 and the torsion spring 110 as described is that the switch selector ring 210 can be configured to rotate in either a clockwise or a counterclockwise direction and can be activated single handedly when the device is held in any orientation. Thus, an operator of a handheld medical/dental screening or diagnostic device incorporating the switch assembly 100 can easily and quickly assess light being reflected or emitted by tissue illuminated by different selected light sources having various wavelengths.

It should be appreciated by those skilled in the art that the conception and the specific embodiment of the switch assembly 100 disclosed herein might be readily utilized as a basis for modifying or redesigning the switch assembly for carrying out the same purposes. It should be realized by those skilled in the art that such equivalent constructions do not depart from the spirit and scope of the invention as set forth in the appended claims

What is claimed is:

1. A rotary switch for activating a multifunctional powered device, the switch comprising:

a conductive torsion spring having a first end anchored in a device housing;

a rotatable switch selector ring, wherein a second end of the torsion spring is engaged in a detent in the switch selector ring;

a plurality of coaxial conductors separated by electrically nonconductive insulators, the coaxial conductors including a first contact, a second contact, and a switch contact, wherein when the switch selector ring is rotated in a first direction an internal diameter of the torsion spring is reduced and contacts the switch contact;

a microprocessor in communication with the switch contact; and an electrical system in communication with the microprocessor and the multifunctional powered device.

2. The rotary switch of claim 1, wherein when the switch selector ring is rotated in the first direction the second end of the torsion ring is moved toward the first end of the torsion ring and the torsion ring is in a contracted position.

3. The rotary switch of claim 2, wherein when the switch selector ring is released after being rotated in the first direction the second end of the torsion ring moves away from the first end of the torsion ring and biases the switch selector ring in a second opposed direction.

4. The rotary switch of claim 1, wherein the multifunctional powered device has a set number of functions and the microprocessor selectably powers one function of the powered device each time the torsion ring contacts the switch contact.

5. The rotary switch of claim 4, wherein the powered device has a plurality of LEDs (light emitting diodes) and wherein each LED is selectively powered by at least one function of the powered device.

6. The rotary switch of claim 1, wherein the device housing contains a battery in communication with the rotary switch.

7. The rotary switch of claim 6, wherein the first contact is in communication with a positive terminal of the battery.

8. The rotary switch of claim 1, wherein an interior of the device housing is negatively charged.

9. The rotary switch of claim 8, wherein the interior of the device housing is in communication with the second contact and the switch contact.

10. The rotary switch of claim 1, wherein the coaxial conductors are in communication with the electrical system though a contact board having a first ring in communication with the first contact, a second ring in communication with the second contact, and a switch ring in communication with the switch contact.

11. A rotary switch for activating a multifunctional powered device, the switch comprising:

a battery housing having a conductive interior having a negative potential;

a conductive torsion spring having a first end anchored in contact with the conductive interior of the battery housing;

a rotatable switch selector ring, wherein a second end of the torsion spring is engaged in a detent in the switch selector ring;

a plurality of coaxial conductors separated by electrically nonconductive insulators, the coaxial conductors including a first contact in communication with a positive terminal of a battery, a second contact in communication with the interior of the battery housing, and a switch contact, wherein when the switch selector ring is rotated in a first direction an internal diameter of the torsion spring is reduced and contacts the switch contact;

a microprocessor in communication with the switch contact; and an electrical system in communication with the microprocessor and the multifunctional powered device.

12. The rotary switch of claim 11, wherein when the switch selector ring is rotated in the first direction the second end of the torsion ring is moved toward the first end of the torsion ring and the torsion ring is in a contracted position.

13. The rotary switch of claim 12, wherein when the switch selector ring is released after being rotated in the first direction the second end of the torsion ring moves away from the first end of the torsion ring and biases the switch selector ring in a second opposed direction.

14. The rotary switch of claim 11, wherein the multifunctional powered device has a set number of functions and the microprocessor selectably powers one function of the powered device each time the torsion ring contacts the switch contact.

15. The rotary switch of claim 14, wherein the powered device has a plurality of LEDs (light emitting diodes) and wherein each LED is selectively powered by at least one function of the powered device.

16. The rotary switch of claim 11, wherein the coaxial conductors are in communication with the electrical system though a contact board having a first ring in communication with the first contact, a second ring in communication with the second contact, and a switch ring in communication with the switch contact.

17. A rotary switch for activating a multifunctional powered device, the switch comprising:

a battery housing having a negatively charged interior;

a conductive torsion spring having a first end anchored in contact with the negatively charged interior of the battery housing;

a rotatable switch selector ring, wherein a second end of the torsion spring is engaged in a detent in the switch selector ring, whereby when the switch selector ring is rotated in a first direction the second end of the torsion spring is moved toward the first end of the torsion ring placing the torsion ring in a contracted state and when the switch selector ring is released after the torsion spring is contracted the second end of the torsion ring moves away from the first end of the torsion ring and the torsion ring returns to an at rest state;

a plurality of coaxial conductors separated by electrically nonconductive insulators, the coaxial conductors including a first contact in communication with a positive terminal of a battery, a second contact in communication with the negatively charged interior of the battery housing, and a switch contact, wherein when the torsion ring is in the contracted state an internal diameter of the torsion spring contacts the switch contact;

a microprocessor in communication with the switch contact, wherein the multifunctional powered device has a set of functions and the microprocessor selectably powers one function of the powered device based on a number of times the torsion ring has contacted the switch contact; and an electrical system in communication with the microprocessor and the multifunctional powered device.

18. The rotary switch of claim 17, wherein the powered device has a plurality of LEDs (light emitting diodes) and wherein each LED is selectively powered by at least one function of the powered device.

19. The rotary switch of claim 17, wherein the coaxial conductors are in communication with the electrical system though a contact board having a first ring in communication with the first contact, a second ring in communication with the second contact, and a switch ring in communication with the switch contact.

20. The rotary switch of claim 18, wherein the electrical system includes a heat sink in thermal communication with the rotary switch and the plurality of LEDs.

* * * * *